US005915432A

United States Patent [19]

Trummer

[11] Patent Number: 5,915,432

[45] Date of Patent: Jun. 29, 1999

[54] CLUB CLEANER

[76] Inventor: Marcus A. Trummer, 141 Broken Rock Dr., Henderson, Nev. 89014

[21] Appl. No.: 08/870,431

[22] Filed: Jun. 6, 1997

[51] Int. Cl.[6] ..... A46B 13/02

[52] U.S. Cl. ..... 15/23; 15/21.1

[58] Field of Search ..... 15/21.1, 23, 34, 15/38, 28, 24

[56] References Cited

U.S. PATENT DOCUMENTS

| | | | |
|---|---|---|---|
| 1,019,672 | 3/1912 | Lineback | 15/34 |
| 1,109,088 | 9/1914 | Taylor | 15/23 |
| 3,066,336 | 12/1962 | Stobbe | 15/21.1 |
| 3,276,060 | 10/1966 | Stokes | 15/21.1 |
| 3,332,099 | 7/1967 | Reiter | 15/21.1 |
| 3,551,933 | 1/1971 | Jaeger | 15/34 |
| 3,729,761 | 5/1973 | Lashley | 15/34 |
| 3,831,217 | 8/1974 | Odawara | 15/34 |

FOREIGN PATENT DOCUMENTS

| | | | |
|---|---|---|---|
| 27 01657 | 8/1994 | France | 15/21.1 |
| 9319658 | 10/1993 | WIPO . | |

*Primary Examiner*—Randall E. Chin
*Attorney, Agent, or Firm*—David O'Reilly

[57] ABSTRACT

The Club Cleaner is a golf device, utilized to deep clean club heads after every stroke of play. The Club Cleaner is a handheld, water resistant, rechargeable, battery operated module which can be attached to any existing golf apparatus. Club Cleaner is used by inserting a dirty club head into one side of the module. Activation occurs by the golfer pressing the power button after choosing one of two cleaning cycles. Multiple horizontal and vertical cylinders, coated with lines of bristles, facilitate a 180-degree cleaning platform. Through the use of gearing, the Club Cleaner cleans the entire club head simultaneously. This creates a channeled flow of residual debris out through the disposal portal at the opposite end of the module.

25 Claims, 4 Drawing Sheets

CLUB CLEANER

BACKGROUND OF THE INVENTION

The invention herein resides in the field of devices for cleaning golf club heads and club head grooves. This invention is a module for cleaning a club head and its grooves with positioned brushes which rotate upon operation, providing 180 degrees of cleaning coverage. More specifically, this rechargeable, battery operated, hand-held device removes debris from the club face grooves when the entire club head is placed into the insertion area. The club head is then cleaned in a simultaneous fashion within an area of cleanability by channeling debris out through the module exit hole.

In the game of golf, it is extremely important to keep the clubs free from interference. The slightest debris can alter a well placed shot a few degrees, and depending on the club this could be anywhere from a few to hundreds of feet. The present spectrum of devices and brushes that are available to golf consumers are inaccurate and usually consume valuable time in application. The use of dampened towels to clean one's clubs usually causes a golfer to lose his/her grip on respective clubs during the next shot of play; existing brushes must be forcefully applied numerous times, hindering the grip of the golfer's next shot. Other products provide a singular mechanical brush in which the golfer must, once again, push the device back and forth to attain the desired spotless club head. Those inventions requiring water, in most cases, will affect the golfer's grip, even if only the slightest touch of water moistens the golfer's hand. A module based mechanism in which a golfer merely presses a button to deep clean an entire club head simultaneously and effortlessly does not exist. With this module, there is no need for constant washing, exchanging of cleaning agents, or physical exertion, all of which can affect the next shot of play.

BRIEF SUMMARY OF THE INVENTION

Based on the problems associated with present club cleaning products, the "Club Cleaner" invention resolves these problems by cleaning the entire club head without requiring any physical exertion on the part of the golfer. The invention described below will be used to economically and efficiently clean club heads, portions of the shaft, and deep clean the club grooves by simply inserting a club head into the module, whose area of cleanability is larger than the entire conventional club head.

The following disclosures support the Club Cleaner invention, whose purpose is to enhance the play of golfers by providing them with clean clubs after every shot of play. After each stroke, the player can utilize the hand held device which is easily accessible when attached to any existing golf bag. The player then inserts the club head into the module and begins operation by depressing the On/Off button. The micro-motor, powered by rechargeable batteries, with the help of gearing technology, initiates the rotating bristles to deep clean the club head.

The Club Cleaner invention cures the existing problems; it takes the cleaning responsibility completely out of the golfer's hands. There is no need to wet down clubs, brush furiously with plain brushes, or scrub them clean after each round of play. The cleaning process will take a few seconds after each shot and will leave any given club clean for the next shot of play. The rechargeable Club Cleaner module provides 180-degree cleaning to the face and sides of the club head. The entire club head is cleaned simultaneously, with multiple sets of rotating brushes, while the debris is channeled through the Club Cleaner module out through a designated exit hole.

BRIEF DESCRIPTION OF THE SEVERAL VIEWS OF THE DRAWING

The attached figures consist of the following, and make reference to, the detailed description outlined below.

DETAILED DESCRIPTION OF THE INVENTION

Figure 1:
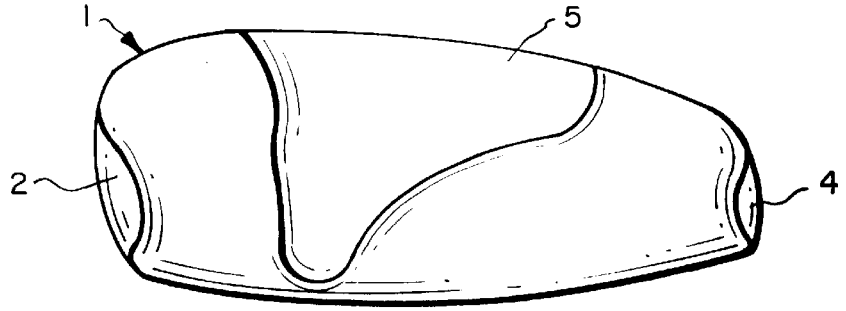
FIG. 1 is a side view portraying the standard module with its entry and exit holes and contour molding.

The Club Cleaner is sized such that it can be easily carried in one hand. In particular, the portable golf club cleaner provides an efficient cleaning device that can be attached to a golf bag, pull cart, an electric golf cart, or similar golfing equipment. It will also be cherished, because the portable golf club cleaner is electrically powered; therefore, the golfer is not required to exert himself operating it during a given round of play. The Club Cleaner module (1) [All references to the following figures] is the encompassing unit for the inner housing (18), which is comprised of the micro-motor (19), the cylinders (8) lined with positioned bristles (10), and area for club insertion (15). The module (1) facilitates operation via triggering the power button (3) which is located on the contour molding (5) at the brim of respective golfer's index finger. Upon depression of the ON/OFF button (3) an electrical impulse is sent to the micro-motor (19). The micro-motor (19) is powered by rechargeable batteries (22) through the use of multiple battery tabs (23) and tab connectors (24). The micro-motor (19) houses a power shaft (13) which initiates the operation of the struts (9). The struts (9) provide the rotation through multiple gears (12) to the three sets of three cylinders (8). The cylinders (8) are covered with specialized bristles (10) which rotate in simultaneous fashion creating a large cleaning area which can negotiate the entire club head (6) and respective club head grooves (7).

The actual operation or use of the Club Cleaner module is as follows. A golfer will hold the module (1) with the bottom facing the ground and the insertion hole (15) pointing to the left. (Depiction for right hand golfers, all of the following will be performed in reverse for left handed golfers) This leaves the exit hole to the right of the little finger and pointing to the right. The golfer's hand grips the module on the top, and sides, of the module utilizing the contour molding (5) as a reference. The golfer will place his/her index finger within the contour molding with the tip of the index finger on the On/Off button (3). The golfer will then grip his/her club by the end of the club so that the club head affixed on the shaft is positioned inward from the left hand. The golfer will then insert the entire club head (6) into the insertion area (15), between the opening flaps, and into the cleaning area. The golfer will hold the club face up, the module down and depress the operation button.

Further explanation of operation through related figures:

FIG. 1—The module (1) is shown in the standard side view depicting the core external components. These components are the contour molding (5), which allows the golfer to grip the module, the front opening (2), and exit hole (4). The module is comprised of an upper and lower molding which can be constructed of either plastic, wood, or equivalent material. This molding houses the functional components detailed in FIGS. 3, 5, 6, 7, 8.

Figure 2:
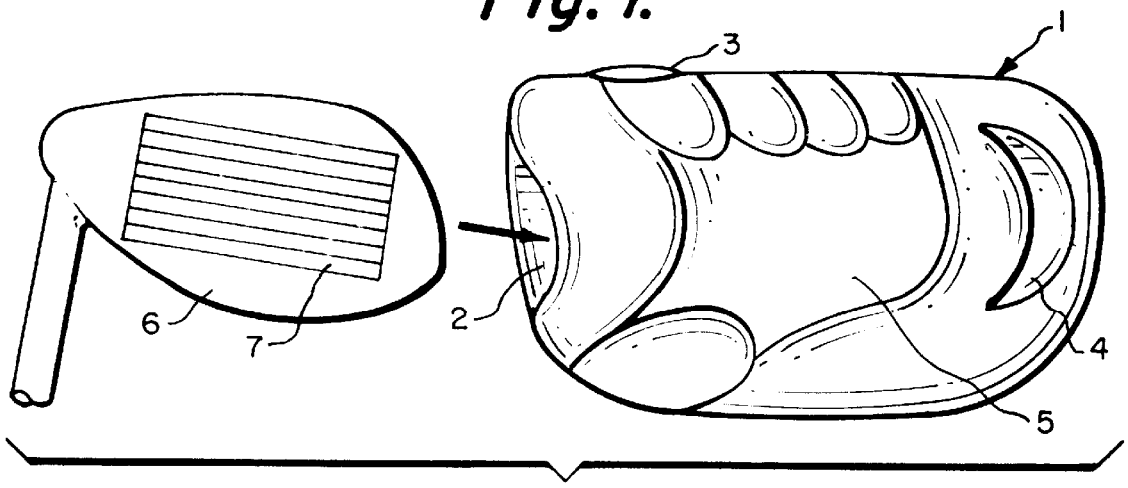
FIG. 2 is a top view of the module detailing the finger grip curvature and entry area. This figure details the operation button and how the module will be used through the insertion of the respective club head.

FIG. 2—This top view is the operation view. By placing your right hand, thumb pointing toward your body, and hand reaching out in front of the body, is how the contour molding (15) allows easy gripping of the module (1). Your left hand grips the bottom of the club shaft with the toe and club head pointing to the right, parallel with the Club Cleaner module. This is the standard operating position.

Once held, the golfer inserts the club head (6) straight into the module (1) through the front opening (2) into the insertion area. Once inserted, the golfer will depress the On/Off button (3) which begins the cleaning process. The debris on the club head (6) and related club head grooves (7) will be channeled through the module (1) out through the exit hole (4). This process completes the cleaning within a few seconds.

Figure 3:
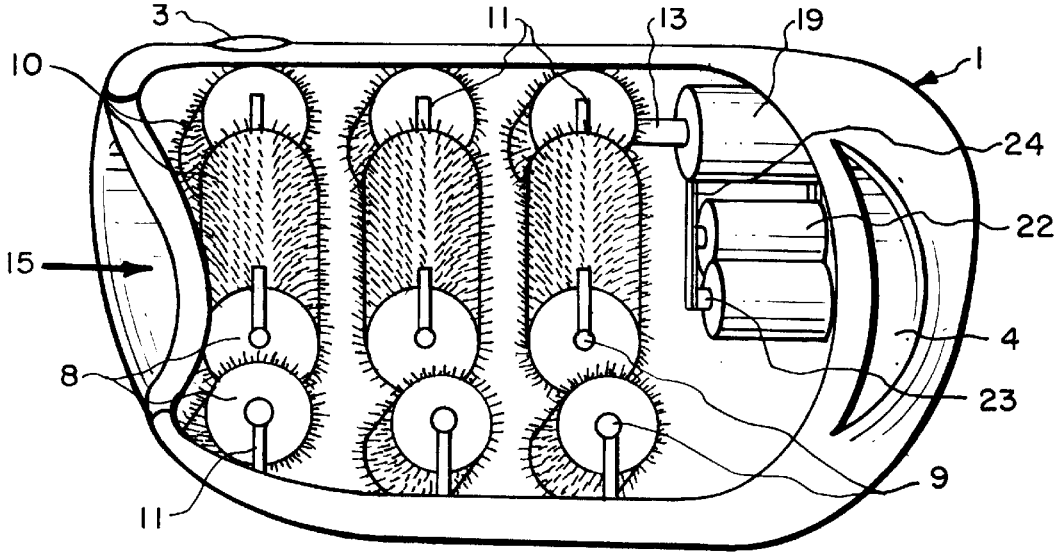
FIG. 3 is a top view of the module with the cover removed to expose the functional cleaning components. One can see two sets of vertical brushes and one set of horizontal brushes. These three sets of brushes facilitate an area which will clean an entire club head in simultaneous fashion. Also, the configuration of the openings, operation button, batteries, and micro-motor are detailed.

FIG. 3—This cross-sectional view of the module (1) details the cylinders (8) configuration. In greater detail, there are three horizontal upper cylinders (8) connected by struts (9) and rotated by the gearing configurations (12). These three upper horizontal cylinders (8) are mounted to the inner housing of the module (1) and are held together by six supports (11). Also depicted are the six vertical cylinders (8) which line the two sides of the module (1). All of these cylinders (8) are lined with cleaning bristles (10) which, when in operation, rotate in simultaneous fashion further detailed in FIG. 6. The gearing of these components is detailed in FIGS. 7,8. The configuration gives the cleaning area 180 degrees of accessibility to the club head, detailed as the insertion area (15). The composition and make of the cylinders can be various with positioned bristles being stiff in nature but not abrasive enough to scratch club head alloys. The power shaft (13) is extended from the micro-motor (19) and is powered by two Nickel Cadmium rechargeable batteries (22), via battery tabs (23) and tab connectors (24) which is all positioned efficiently beside the micro-motor (19).

Figure 4A:
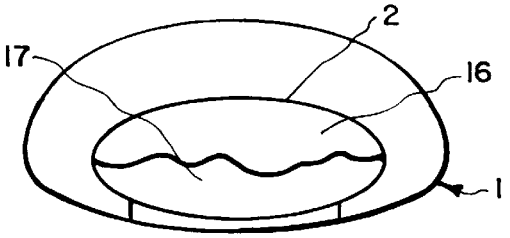
FIGS. 4(*a*) and 4(*b*) details frontal views of the module. One view details the flaps which allow access to the rotating brushes. The other shows a frontal view with the front of the module removed to show, once again, the area which facilitates club cleaning through the utilization of three sets of brushes. This figure also details how the bottom of the module can be removed to accommodate larger clubs.
Figure 4B:
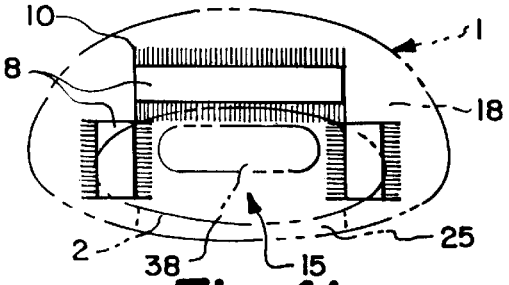

FIG. 4—This frontal view shows the front opening (2) of the module (1), and details the process in which the golfer inserts the dirty club head through the flaps (16) via the flap slit (17). The rotating cylinders (8) and the insertion area (15) define a front opening (2) which receives the golf club head to be brushed. This allows the cylinder bristles (10) to access and clean the club head grooves in 180-degree fashion. The bottom figure details the same view with a cross-sectional outlook of the module (1), whose housing (18) houses the cylinders (8) and bristles (10) surrounding the insertion area (15). One can also see the area of cleanability (38) the cylinder configurations create. This view also details the removable bottom (25) so the golfer may clean larger driving clubs as well.

Figure 5A:
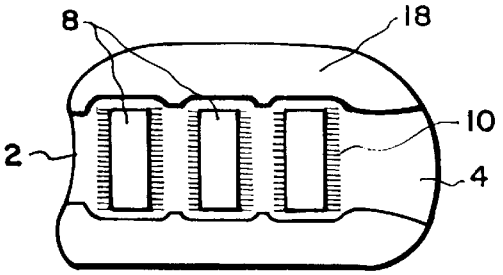
FIGS. 5(*a*) through 5(*c*) is a cross-sectional view depicting the top and bottom of the module as if cut through the center of the side view depicted in the middle. This figure shows how the three sets of bristles are configured within the contour molding and respective housing in relation to the operational components detailed in FIGS. 7 and 8.
Figure 5C:
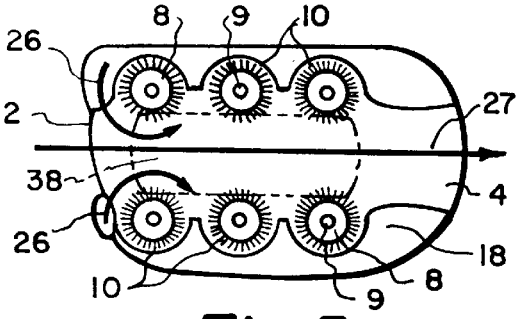
Figure 5B:
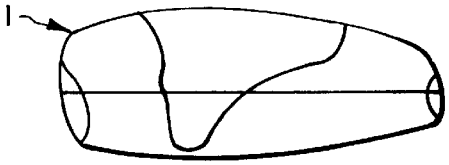

FIG. 5—This figure splits the module (1) depicted in operational view in the center of the three figures, by butterflying the top and bottom at the center of the module (1). The top figure details the cylinder configuration of the three upper horizontal brushes (8 & 10). The bottom half depicts the two sets of vertical cylinders (8) lined with bristles (10) and powered struts (9) on either side of the module housing (18). This bottom figure also details the rotation (26) of the cylinders (8) and their creation of the debris flowpath (27) which flows from the entry hole (2) through the cleaning area (38) and out through the exit hole (4).

Figure 6:
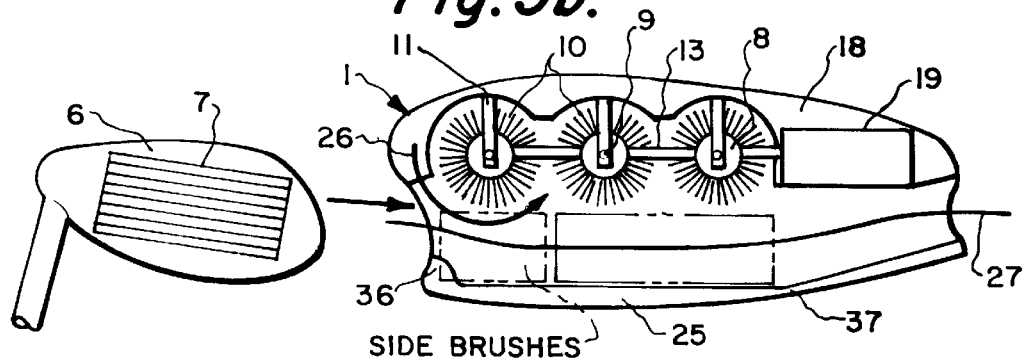
FIG. 6 is a cross-sectional side view which provides an interpretation of the channeled flowpath which is created by the module's 180-degree brushes. This figure also details how the brushes on operational components are laid out from a side perspective.

FIG. 6—This figure details the Club Cleaner module with the side cover removed, revealing the housing (18) which supports the operational components. The compartment has a front wall, sidewalls and a section facilitating the micro-motor (19). The sidewalls support each end of the cylinders (8). The micro-motor (19) is affixed to the rear of the module (1) and is mounted by a water tight adhesive or other water resistant sealer. The powershaft (13) connects the micro-motor (19) to the cylinders (8). The cylinders (8) have a respective strut (9) facilitating the rotation motion so that the bristles (10) affixed to the cylinders (8) may perform the cleaning operation. In a manner known to those skilled in the art, the cylinders are contained within the module (1) housing (18). In detail, the cylinders have cylindrical housing (18) supports (11) which are mounted on cylindrical housing struts (9). Those skilled in the art will appreciate that the cylindrical housing strut (9) is secured at both ends to the module (1) housing (18). This diagram also simulates the debris flowpath (27) from the club head (6) and related club head grooves (7) through the module (1) and out the exit hole. This flow path (27) is channel-like in nature. This channel is formed from the rotation of the nine respective cylinders (8). Six cylinders (8) rotate from the outside to inside as caused by the rotation generated by the gearing configuration detailed in FIGS. 7, 8 and depicted earlier in FIG. 5. The flowpath (27) is further enhanced by the rotation motion (26) from the three horizontally mounted cylinders (8) which are held up by six supports (11). These upper cylinders (8) rotated from top to bottom and from front to back (26). This figure also details the button (36) and the hinge (37) which allow the removable bottom (25) to be opened, thus allowing the golfer to clean his/her drivers.

Figure 7:
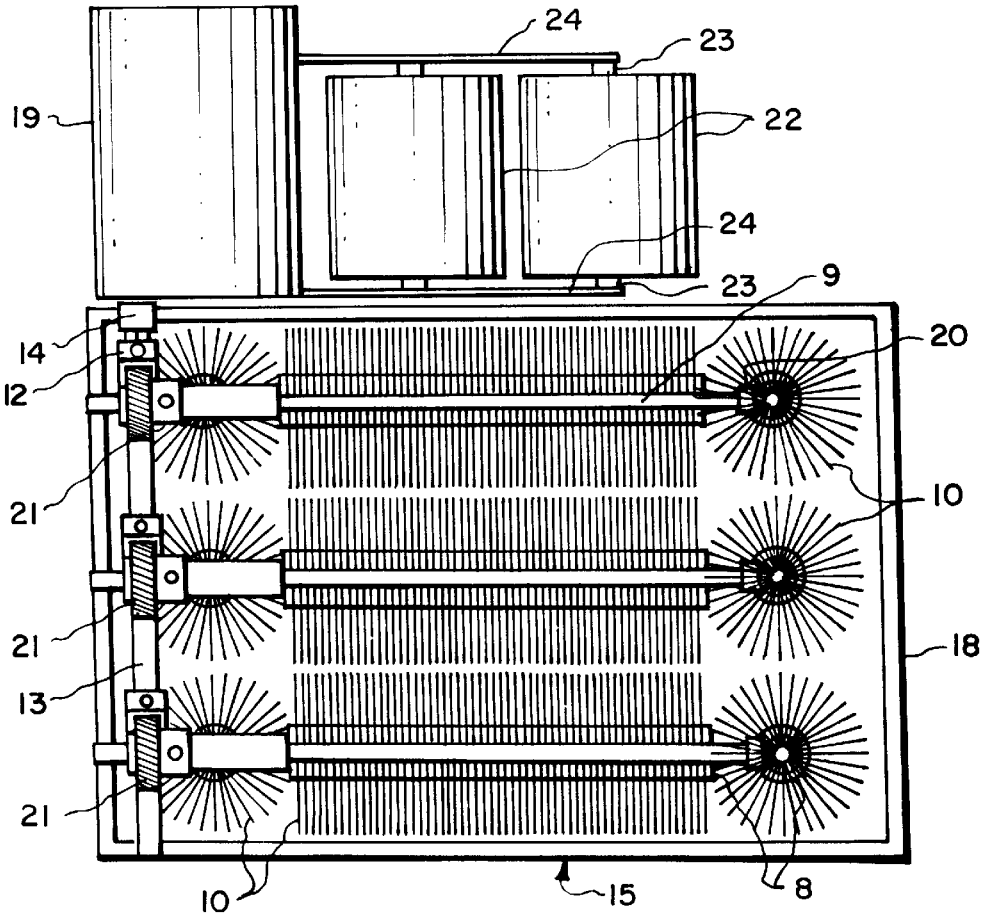
FIG. 7 is a top view which details the gearing configuration and functional components of the brushes, shafts, and gearing struts needed for the operation of the three sets of brushes.
Figure 8:
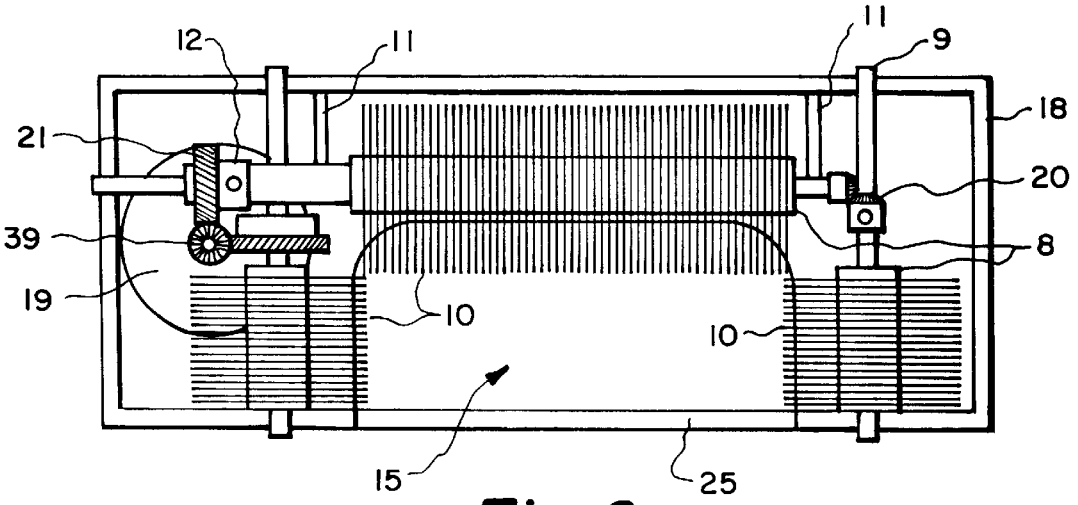
FIG. 8 is a frontal view detailing the gearing and cylinder configuration and how rotational power is achieved by one power shaft.

FIG. 7—This figure details a top view of the operational components only. Power is delivered within the housing (18)

to the micro-motor (19) from the Nickel Cadmium batteries (22) through the use of positive and negative battery tabs (23) and tab connectors (24). The micro-motor (19) rotates the power shaft (13) through the clutch (14) to the gearing configurations (12). The upper horizontal bristles (10) are rotated through the use of the respective worm wheels and the related horizontal struts (9) which the cylinders (8) are attached to. This figure summarizes that all nine cylinders (8) are rotated by one power shaft (13) through the use of the gearing configuration (12). FIG. 8 details how power is transferred to the vertical cylinders. Briefly, the left verticals are linked directly to the power shaft (13) through the use of worm gears, while the right set receives power through the horizontal struts (9) via miter gears (20) which is further portrayed in FIG. 8. The figure also details the insertion area (15) for reference purposes for operation.

FIG. 8—This figure details a frontal view of only the housing (18) and gearing operational components as detailed from the top view in FIG. 7. This figure depicts how rotational power is given to the vertical cylinders (8). The power shaft detailed in FIG. 7 drives the gears (12), worm wheels (21), and worm gears (39), which in turn power the respective struts (9). The left set of vertical cylinders (8) are powered solely through the worm gears (39). The right set of vertical cylinders (8) are powered through the horizontal strut (9) which is anchored to the housing (18) by supports (11) and end with three miter gears (20) [one for each strut] which rotate the respective right struts (9). This figure also details the cylinders (8) lined with bristles (10) as well as where the insertion area (15) is. This figure further details, from a new angle, the removable bottom (25) for direct access to bristles.

Figure 9:
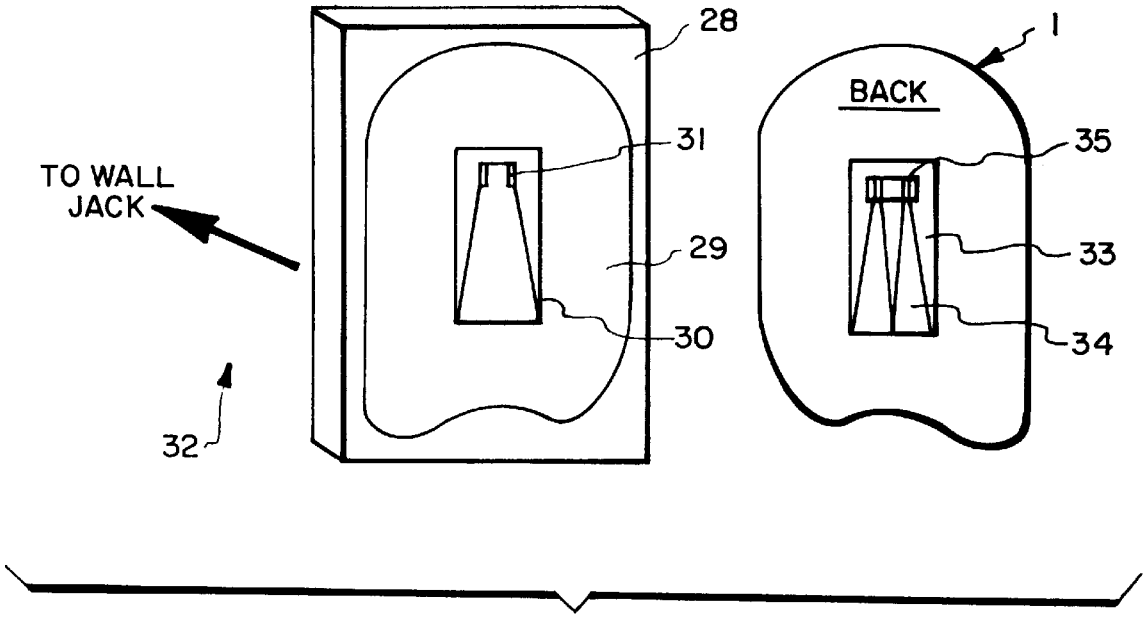
FIG. 9 is a bottom/back view of the module and the respective wall apparatus receptor for module recharging.

FIG. 9—Another aspect of the present invention is that the power supply is a rechargeable set of Nickel Cadmium batteries. This diagram details how the batteries, in aforementioned figures, would receive charge through the utilization of the wall module (28). The module's (1) housing has positive and negative battery tabs whose operation is outlined below. The wall module (28) is plugged into any standard AC unit (32). The back of the module (1) has a module charge adapter (33) with twin access channels (34) allowing the tab connector plate (35) and associated charge tabs-module to be connected to the wall module (29) recharge area. The wall module (28) has contour molding (29) which allows the module (1) to be affixed for recharging. The charge tabs (35) on the module (1) slide into the access channel-adapter (30) allowing the connection to the charge tabs-adapter (31) which initiates the recharging process.

Thus, it can be seen that the objects of the Club Cleaner invention have been satisfied by the module described in the aforementioned figures and descriptions. It should be apparent to those skilled in the art that the components of the present invention can be operated with an electrical power supply and will easily remove debris from any existing golf club efficiently and with effective results. The invention here-in creates a cleaning field of 180 degrees through multiple positioned brushes. These brushes cylindrical rotational force, create a channeling of coverage area, larger than a golf club head, for which debris is forced off the club head and out through the exit hole.

What I am claiming my invention is:

1. A portable golf club cleaning apparatus comprising;

a housing having an entrance aperture contoured to receive a golf club head, said housing contoured to fit the palm and fingers of a user's hands to facilitate operation and use;

a first plurality of parallel brushes adjacent said entrance constructed and arranged to engage a face of said golf club head inserted in said entrance aperture;

a second plurality of brushes substantially perpendicular to said first plurality of brushes constructed and arranged to engage at least the sole of said golf club head when inserted in said entrance;

said second plurality of brushes comprising a plurality of brushes connected at each end of and perpendicular to said first plurality of brushes; whereby both the sole and upper peripheral edge of said golf club head are cleaned of debris when inserted in said entrance;

drive means for driving said brushes when said golf club is inserted in said entrance;

activating means for activating said drive means;

whereby a golf club head may be inserted in said entrance and cleaned of debris by rotating said first and second plurality of brushes.

2. The apparatus according to claim 1 in which said drive means comprises; a battery operated micro-motor; and connecting means connecting said first and second plurality of brushes to said battery operated micro-motor.

3. The apparatus according to claim 2 in which said connecting means comprises gear means connecting said first and second plurality of brushes to said drive motor.

4. The apparatus according to claim 3 in which said gear means includes bevel gears connecting drive shafts of said second plurality of brushes to drive shafts of said first plurality of brushes for simultaneous rotation therewith.

5. The apparatus according to claim 4 which said housing includes an exit aperture in line with and at an opposite end of said housing constructed and arranged to discharge debris out of said housing as it is cleaned from said golf club head by said plurality of brushes.

6. The apparatus according to claim 5 in which said activating means comprises an on/off switch on an exterior of said contoured housing positioned for easy operation by a finger.

7. The apparatus according to claim 6 including reverse means for reversing rotation of said first and second plurality of brushes to effect deep cleaning of grooves in said club head face.

8. The apparatus according to claim 7 including electrical connecting means for connecting said golf club cleaning apparatus to a power source.

9. The apparatus according to claim 8 in which one side of said housing can be opened for cleaning larger golf club heads.

10. The apparatus according to claim 9 in which said second plurality of brushes comprises three rotatable brushes at each end and perpendicular to said first plurality of brushes.

11. The apparatus according to claim 8 in which said second plurality of brushes comprises at least three brushes at one end and perpendicular to said first plurality of brushes.

12. The apparatus according to claim 7 in which said first plurality of rotatable brushes comprises three parallel brushes.

13. The apparatus according to claim 2 in which said housing includes an exit aperture in line with and at an opposite end of said housing constructed and arranged to discharge debris from said housing as it is cleaned from said golf club head by said plurality of brushes.

14. The apparatus according to claim 13 including reverse means for reversing rotation of said first and second plurality of brushes to effect deep cleaning of grooves in said club head face.

15. The apparatus according to claim 14 in which one side of said housing can be opened for cleaning larger golf club heads.

16. The apparatus according to claim 15 in which said first plurality of rotatable brushes comprises three parallel brushes.

17. The apparatus according to claim 16 in which said second plurality of brushes comprises three rotatable brushes at each end and perpendicular to said first plurality of brushes.

18. An apparatus according to claim 1 in which said drive means comprises; a battery operated micro-motor; and connecting means connecting said first and second plurality of brushes to said battery operated micro-motor.

19. An apparatus according to claim 18 in which said connecting means comprises gear means connecting said first and second plurality of brushes to said drive motor.

20. An apparatus according to claim 19 in which said gear means includes bevel gears connecting drive shafts of said second plurality of brushes to drive shafts of said first plurality of brushes for simultaneous rotation therewith.

21. An apparatus according to claim 20 in which said housing includes an exit aperture in line with and at an opposite end of said housing constructed and arranged to discharge debris out of said housing as it is cleaned from said golf club head by said plurality of brushes.

22. An apparatus according to claim 21 including reverse means for reversing rotation of said first and second plurality of brushes to effect deep cleaning of grooves in said club head face.

23. An apparatus according to claim 22 including electrical connecting means for connecting said golf club cleaning apparatus to a power source.

24. An apparatus according to claim 23 in which one side of said housing can be opened for cleaning larger golf club head.

25. An apparatus according to claim 24 in which said first plurality of rotatable brushes comprises three parallel brushes.

* * * * *